US006453965B1

(12) United States Patent
White

(10) Patent No.: US 6,453,965 B1
(45) Date of Patent: Sep. 24, 2002

(54) CLOSURE STICKER APPLICATOR

(75) Inventor: Nigel White, Wilberfoss (GB)

(73) Assignee: Holmdale Precision Limited, East Yorkshire (GB)

( * ) Notice: Subject to any disclaimer, the term of this patent is extended or adjusted under 35 U.S.C. 154(b) by 142 days.

(21) Appl. No.: 09/686,161

(22) Filed: Oct. 11, 2000

(30) Foreign Application Priority Data

Oct. 12, 1999 (GB) ..... 9924163

(51) Int. Cl.[7] ..... B65H 18/28; B65H 19/29; B65H 75/28

(52) U.S. Cl. ..... 156/443; 156/542; 156/556; 156/566; 156/191; 242/532.3

(58) Field of Search ..... 156/556, 443, 156/446, 542, 558, 559, 566, 191; 242/532.3, 172, 173

(56) References Cited

U.S. PATENT DOCUMENTS 3,393,105 A * 7/1968 Tellier, Jr. ..... 156/187
4,475,974 A * 10/1984 Perini ..... 156/187
5,030,311 A * 7/1991 Michal et al. ..... 156/256
5,759,326 A * 6/1998 Vigneau ..... 156/187
6,085,820 A 7/2000 Ryan
6,142,206 A 11/2000 Ryan
6,220,541 B1 4/2001 Caprario

FOREIGN PATENT DOCUMENTS

JP 2000-351498 A * 12/2000 ..... B65H/19/29

* cited by examiner

*Primary Examiner*—Richard Crispino
*Assistant Examiner*—Sue A. Purvis
(74) *Attorney, Agent, or Firm*—Fay, Sharpe, Fagan, Minnich & McKee, LLP

(57) ABSTRACT

An applicator for applying a closure sticker to the free end of each of a plurality of rolls (18) mounted side by side, comprises a dispenser (1) for dispensing closure stickers one after the other to a single pick up point (10) and a mount (12) carrying a plurality of closure sticker applicator heads (4–7). The heads (4–7) are spaced along the mount (12) by the pitch of the rolls (18) to which the closure stickers are to be applied and an indexing mechanism (17) moves the mount (12) past the pick up point (10) such that each applicator head (4–7) in turn can pick up a closure sticker. Finally, means (13,14,15,16) for moving the mount (12) ensures that the applicator heads (4–7) are brought into engagement with the said rolls, simultaneously and each with a respective one.

12 Claims, 3 Drawing Sheets

CLOSURE STICKER APPLICATOR

The present invention relates to an applicator for applying a self-adhesive closure label or sticker to the free end of a roll to prevent unwinding and tangling thereof. More specifically, the present invention relates to an applicator for applying a closure label or sticker to the free end of each of a plurality of rolls simultaneously. The present invention further provides the option of printing data relating to a roll on the label prior to application.

It is known within the label manufacturing industry to rewind rolls of labels or tickets from a primary roll. The rewound rolls form smaller secondary rolls of manageable size which can be used directly in a dispensing apparatus. Several secondary rolls may be rewound simultaneously from a corresponding number of primary rolls using an appropriate winding machine. Typically, such a machine comprises two or more rewind mandrels, onto each of which, in turn, several secondary rolls are rewound. This type of winding machine has a relatively short operating cycle and is very efficient.

Once the secondary rolls on the rewind mandrel have reached the required diameter their connections to the primary rolls are cut and the lose ends of the primary rolls are connected to the next rewind mandrel for the next group of secondary rolls to be rewound. Of course, this leaves the loose ends of the rewound secondary rolls to flap about. To ensure that the loose ends of the secondary rolls do not begin to unwind and become damaged it usual to tape them down using a self-adhesive closure sticker. Sometimes the sticker may take the form of a label with data relating to the secondary roll printed on it.

Self-adhesive closure stickers can be applied manually. This method of roll closure is performed by an operator who takes a self-adhesive label and applies it by hand to the free end of a roll. This is time consuming and can result in poor roll quality because the rolls must be removed from the rewind mandrel of the winding machine to provide access for the operator to the loose end. Once ejected from the winding machine the roll may start to loosen and unwind itself and the end may be damaged.

An alternative method of application for the self-adhesive closure stickers makes use of an automatic multi-lane sticker applicator. This method of roll closure is performed by a sticker applicator which can handle a similar web width to that of the rewind mandrel. This method is very effective but requires the self-adhesive web of the sticker applicator to be die cut to suit the product which is being turret rewound.

As an alternative to taping down the free end of each roll, the free end may be glued down. This method of roll closure is performed as the web connecting the primary roll to the secondary roll is cut. As the knife cuts the web the tail or free end of the secondary roll is passed over a hot-melt glue bath which puts a small deposit of glue on the underside thereof, which then sticks itself to the previous wrap of the rewound secondary roll. Although this is effective, it is sometimes not an option to some customers who cannot permit the presence of any glue on the rewound roll.

It is an object of the present invention to provide an applicator for applying self-adhesive closure labels or stickers to the free ends of rewound secondary rolls in a winding apparatus.

It is a further object of the present invention to provide an applicator for applying a closure sticker to each of a plurality of rewound secondary rolls positioned side by side simultaneously.

It is yet another object of the present invention to provide an applicator for applying closure stickers combined with a printer for printing information on the closure stickers.

According to the present invention there is provided an applicator for applying a closure sticker to the free end of each of a plurality of rolls mounted side by side, comprising a dispenser for dispensing closure stickers one after the other to a single pick up point, a mount carrying a plurality of closure sticker applicator heads, the heads being spaced along the mount by the pitch of the rolls to which the closure stickers are to be applied, an indexing mechanism for moving the mount past the pick up point such that each applicator head in turn can pick up a closure sticker, and means for moving the mount such that the applicator heads are brought into engagement with the said rolls, simultaneously and each with a respective one.

An embodiment of the present invention will now be described, by way of example, with reference to the accompanying drawings, in which.

Figure 1:
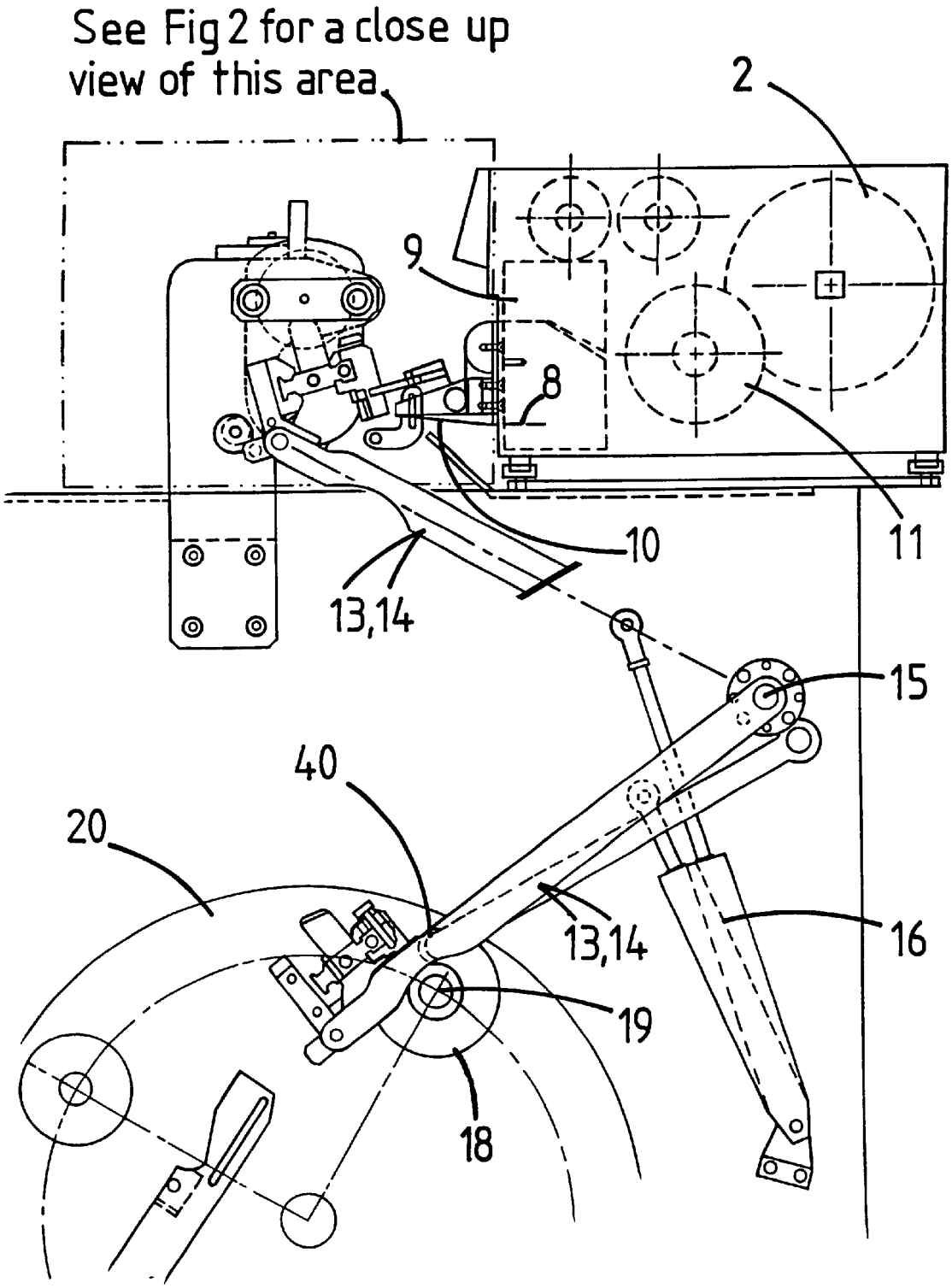
FIG. 1 is a schematic side view of an applicator for closure stickers embodying the present invention.
Figure 2:
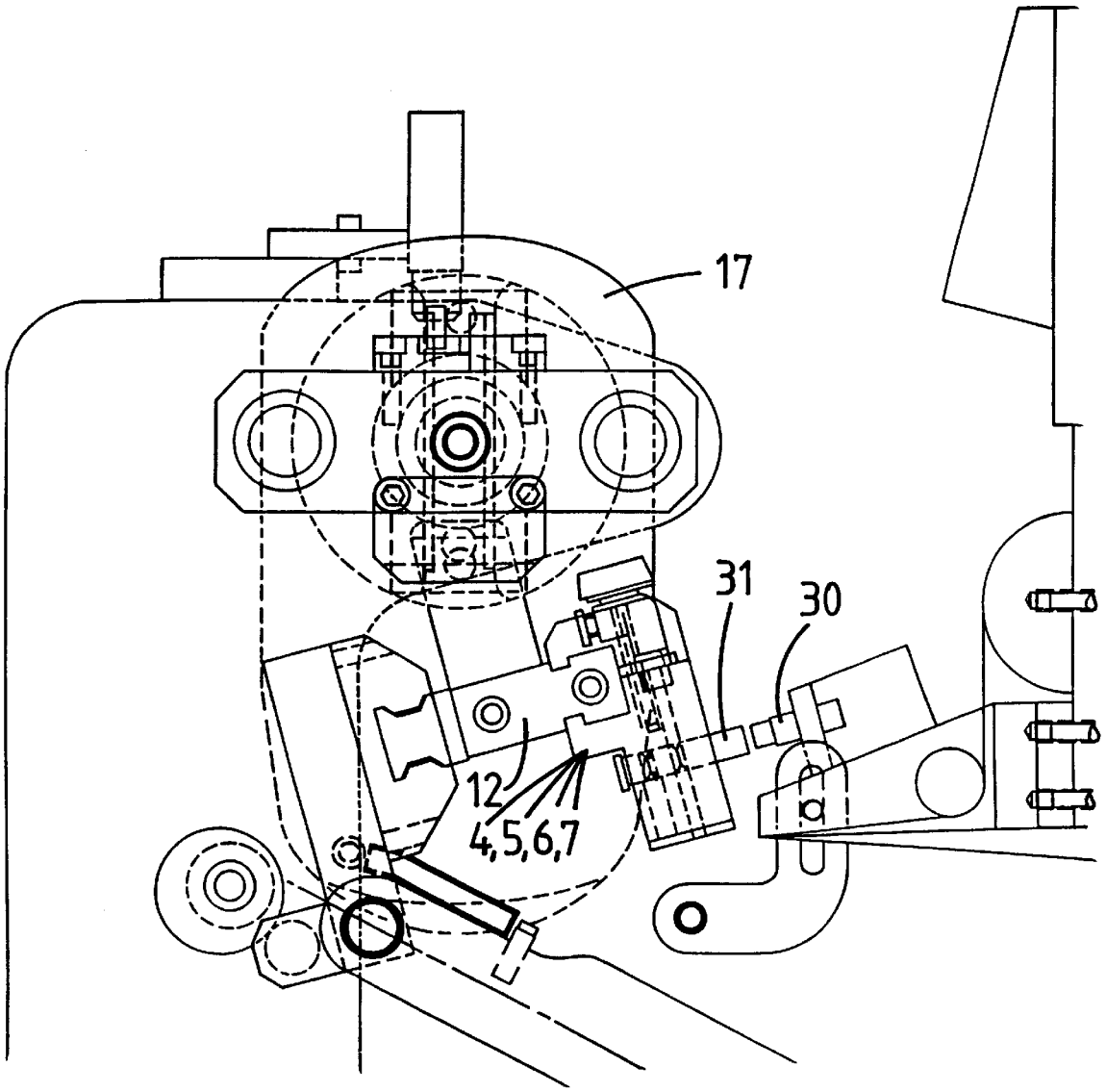
FIG. 2 is a detail of a sticker applicator head and the sticker dispenser.

Referring to the drawings there is shown a combined sticker dispenser and printer, generally designated at 1, which dispenses self-adhesive stickers from a roll 2 onto each of four label applicator heads 4 to 7 in turn. The supporting web 8 carrying the stickers passes through a printing head 9, over a beak 10 and onto a rewind spool 11. Within the printing head 9 data relating to the roll (not shown) to which a particular closure sticker is to be applied is printed on the sticker. The beak 10 serves to strip stickers from the web 8 as it passes around it. The actual passage of the web 8 around the beak 10 is synchronised with the operation of the sticker applicator heads 4 to 7, as will be explained in detail hereinbelow, so that a sticker is peeled off the web 8 to be picked up by one of the applicator heads 4 to 7 as each applicator head in turn is moved into position in front of the beak 10.

Figure 3:
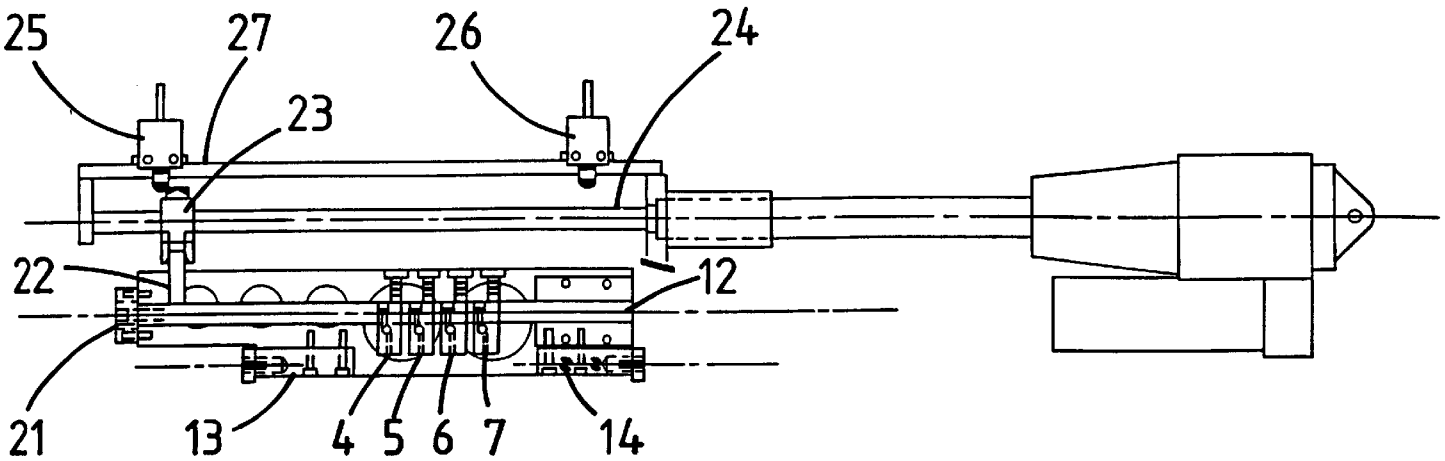
FIG. 3 is a plan view showing the label applicator heads in a "docked" position in which labels are applied.
Figure 4:
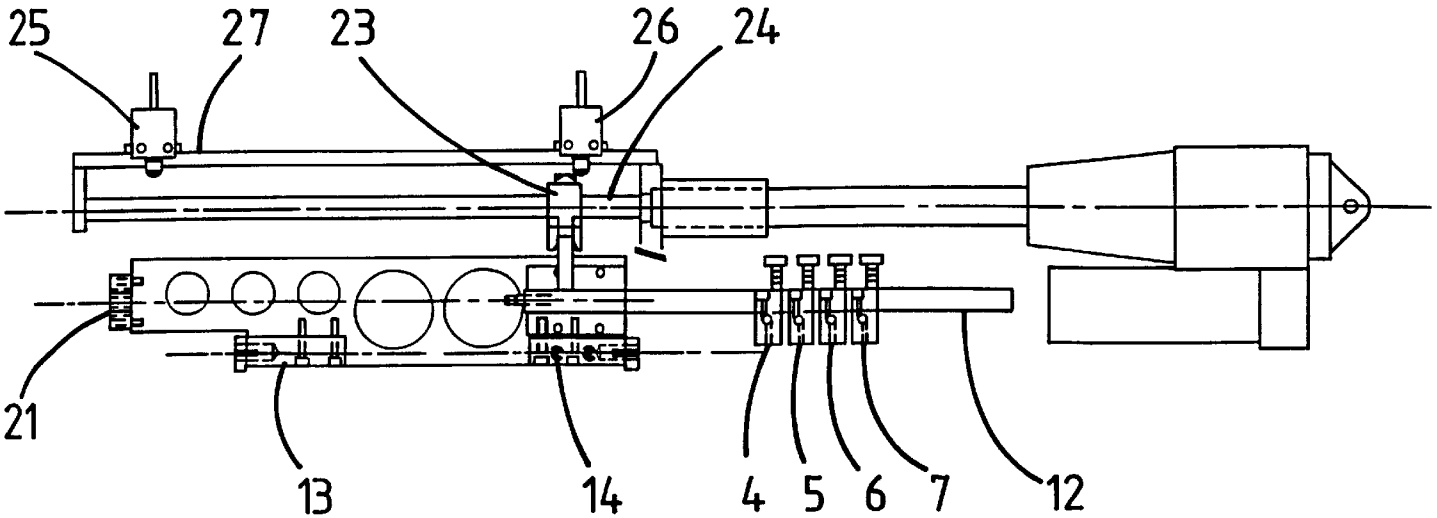
FIG. 4 is a plan view showing the label applicator heads in the retracted position, immediately prior to picking up closure stickers.

The applicator heads 4 to 7 are mounted side by side on a main tooling mount 12, which can best be seen in FIGS. 3 and 4. The actual spacing of the applicator heads 4 to 7 on the mount 12 is adjustable to match the pitch of the rolls to which closure stickers are to be applied. The mount 12 is supported by a pair of side arms 13 and 14 which are pivotable about a pivot axis 15 by means of an hydraulic ram 16. Referring to FIG. 1 it can be seen that the mount 12 is moveable on the side arms between a first, upper position in which the mount lies adjacent to the combined closure sticker dispenser and printer 1, and is engaged with a linear actuator mechanism, generally designated at 17, and a second, lowered position S which each applicator head 4 to 7 engages with a respective one of a number of rolls 18 mounted side by side on a winding mandrel 19 of a winding turret 20. In the first, raised position the mount 12 is shuttled back and forth relative to the beak 10 so that each applicator head 4 to 7 in turn is able to pick up a closure sticker dispensed from the combined dispenser and printer 1. This shuttling action is achieved by the linear actuator mechanism 17 as will be explained in greater detail hereinbelow. In the second, lowered position the closure stickers carried by each applicator head 4 to 7 are applied to the rolls 18, simultaneously and each to a respective one.

As indicated hereinabove the mount 12 is connected to a linear actuator mechanism 17 for the purpose of allowing it to shuttle back and forth relative to the beak 10. The actuator mechanism 17 can best be seen in FIGS. 3 and 4. The mount 12 itself is supported in the "docked" position, i.e. fully forward position between the innermost of the two side arms 13 and 14, and an end support plate 21. The innermost side arm 13 supports a channelled member in which the mount 12 is slidably received, whilst the end support plate 21 receives the outer end of the mount 12 in an aperture. A catch 22 is fixed to the mount 12 at a point near to its outer end and is releasably engaged with a latch mechanism 23 carried by an actuator arm 24 of the actuator mechanism 17.

It will be appreciated that when the actuator mechanism 17 is operated to retract the actuator arm 23, the mount 12 is retracted with it to a filly rearward position. The forward and rearward limits of movement of the actuator mechanism 17, and hence of the mount 12, are set by micro-switches 25 and 26 which are positioned on a support frame 27 of the actuator mechanism 17. The micro-switches 25 and 26 are so positioned as to engage with the latch mechanism 23 as it passes forwards and rearwards, and their relative positions can be adjusted by sliding them back and forth on the support frame 27.

At this stage it is important to appreciate that the connection between the latch mechanism 23 and the catch 22 is disengaged when the mount 12 is pivoted on the side arms 13 and 14 downwards and is re-engaged when the mount is pivoted back up to the top.

In order to ensure that each applicator head 4 to 7 is correctly aligned with the beak 10, for the purpose of picking up a closure label as the mount 12 is shuttled forward past it, a proximity sensor 30 is provided adjacent to the beak 10 and each applicator head 4 to 7 carries a proximity switch flag 31. Using well understood control technology the actuator mechanism 17 is indexed forward until the proximity sensor 30 detects a first proximity switch flag 31, at which point it halts, bringing the applicator head associated with the sensed flag 31 to a stop in front of the beak 10. A closure label removed from the roll by the beak 10 is picked up by the applicator head, whereupon the actuator mechanism is indexed forwards again until the next flag 31 is sensed by the sensor 30. Each of the flags 31 can be depressed so as to make a particular applicator head "invisible" to the sensor 30 which may be useful if the full compliment of applicator heads is not required for a given application.

Each of the applicator heads 4 to 7 has a pad on the bottom with one or more holes in it through which air is drawn in. This negative pressure causes closure labels dispensed over the beak 10 to be picked up and held in place on. The actual pick up of the labels is assisted by a blower (not visible in the drawings) positioned beneath and to one side of the beak which blows the closure labels up onto the pad.

When all of the applicator heads 4 to 7 which are in use have been loaded with closure stickers and the mount 12 is fully docked in the forward position. The mount 12 is swung downwards on the side arms 13 and 14. As the mount 12 swings downwards the catch disengages from the fixed latch on the actuator arm. This action brings the applicator head, complete with self-adhesive labels, down onto the finished rolls in such a way that the label is half on the loose end, and half onto the previous wrap of the rolls.

The vacuum supply to each applicator head 4 to 7 is now turned off, and the side arms 13 and 14 lift upwards to re-engage the catch carried by the mount 12 with the latch carried by the actuator mechanism. The applicator is now ready to repeat the sequence.

A foam control roller 40 is provided to restrain the loose ends of the rolls on the mandrel 19. After the closure stickers have been applied the finished rolls are rotated slightly to enable the foam roller 40 to fully seal down the applied stickers.

The turret disc now indexes ready to eject the finished rolls and repeat the cycle, therefore achieving continuous production at line speed.

What is claimed is:

1. An applicator for applying a closure sticker to the free end of each of a plurality of rolls (18) mounted side by side, comprising a dispenser (1) for dispensing closure stickers one after the other to a single pick up point (10), a mount (12) carrying a plurality of closure sticker applicator heads (4–7), the heads (4–7) being spaced along the mount (12) by the pitch of the rolls (18) to which the closure stickers are to be applied, an indexing mechanism (17) for moving the mount (12) past the pick up point (10) such that each applicator head (4–7) in turn can pick up a closure sticker, and means (13,14,15,16) for moving the mount (12) such that the applicator heads (4–7) are brought into engagement with the said rolls, simultaneously and each with a respective one.

2. An applicator according to claim 1, wherein the closure sticker dispenser comprises printer means for printing onto each sticker.

3. An applicator according to claim 1, wherein operation of the dispenser is synchronised with operation of the indexing mechanism such that a closure sticker is dispensed as each applicator head in turn is indexed past the pick up point.

4. An applicator according to claim 1, wherein the spacing of the applicator heads on the mount is adjustable to match the pitch of the rolls to which the closure stickers are to be applied.

5. An applicator according to claim 1, wherein the mount is supported at least one end by a side arm which is pivotable about a pivot axis to bring the applicator heads into engagement with said rolls.

6. An applicator according to claim 5, wherein the said at least one arm is caused to pivot about the said pivot axis by an hydraulic ram, pneumatic ram or electric motor.

7. An applicator according to claim 1, wherein the indexing mechanism is a linear actuating mechanism which engages with the mount to cause it to shuttle back and forth relative to the pick up point.

8. An applicator according to claim 1, wherein the mount is shuttled between a fully extended position in which the applicator heads are aligned with the rolls and a fully retracted position, between which positions each head in turn collects a closure sticker from the pick up point, the extended position and the retracted position being defined by limit switches or sensors.

9. An applicator according to claim 8, wherein the limit switches or sensors are adjustable in position on a support frame.

10. An applicator according to claim 1, wherein a proximity sensor is provided adjacent the pick up point and each applicator head carries a proximity sensor flag which can be detected by the proximity sensor.

11. An applicator according to claim 10, wherein each proximity sensor flag may be selectively disabled so as to make a particular sensor head invisible to the proximity sensor.

12. An applicator according to claim 1, wherein each applicator head is connected through a switching circuit to a vacuum supply such that a closure label may be selectively picked up, retained in place and released.

* * * * *